US006220573B1

(12) United States Patent
Bromberek

(10) Patent No.: US 6,220,573 B1
(45) **Date of Patent: *Apr. 24, 2001**

(54) METHOD AND APPARATUS FOR HOISTING A VEHICULAR CLUTCH

(76) Inventor: Robert Bromberek, 718 East St., Lemont, IL (US) 60439

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/245,200

(22) Filed: Feb. 5, 1999

(51) Int. Cl.[7] ..... B66F 13/00
(52) U.S. Cl. ..... 254/133
(58) Field of Search ..... 254/133, 134, 254/131, 8 B, 2 B; 29/273, 271

(56) References Cited

U.S. PATENT DOCUMENTS

| | | | | |
|---|---|---|---|---|
| 474,653 | | 5/1892 | Deffler . | |
| 513,201 | | 1/1894 | Robinson et al. . | |
| 698,896 | | 4/1902 | Beierstorf . | |
| 1,029,823 | | 6/1912 | Richardson . | |
| 2,706,535 | | 4/1955 | Marshall . | |
| 3,052,323 | | 4/1962 | Hopfeld . | |
| 3,225,868 | | 12/1965 | Barnes . | |
| 3,753,550 | * | 8/1973 | Criswell | 254/133 |
| 5,033,717 | * | 7/1991 | Symon | 254/8 B |

* cited by examiner

*Primary Examiner*—Robert C. Watson
(74) *Attorney, Agent, or Firm*—Michael R. McKenna

(57) ABSTRACT

A truck clutch jack with a separate shaft for holding the clutch and a movable carriage on a post to which shaft may be attached. This improved clutch jack can stack clutches on a shelf by allowing the shaft to be detached and positioned vertically. One individual can efficiently use this device to install a clutch and/or flywheel under a grade-level truck without the need for a second individual to assist in the installation, due to its considerably smaller floor profile.

21 Claims, 1 Drawing Sheet

METHOD AND APPARATUS FOR HOISTING A VEHICULAR CLUTCH

BACKGROUND OF THE INVENTION

This invention relates to an apparatus for hoisting a vehicular clutch with a central bore comprising a selectably engagable elongated shaft with means for attaching disposed on a first end and with the shaft being suitably sized transversely to fit into the central bore of the clutch, an upright post with a base disposed on the bottom end of the post, a carriage supported on and movable relative to the post, and means for moving the carriage relative to the post. The carriage has a first face with complementary means for attaching adapted for use in engaging the means for attaching to support the shaft in a generally horizontal plane.

Truck clutches often last for only one year and then need to be replaced. With current technology, considerable time and expense are consumed in removing a defective clutch and/or flywheel and replacing it with a new or refurbished one. With this improved jack one is able to assemble and disassemble the clutch and flywheel under the truck allowing for easy installation and removal in even the toughest situations.

This improved manual lifting jack is designed characteristically to lift fourteen inch or fifteen inch spicer clutch assemblies, but may be employed in other capacities were the use of an insertable shaft for lifting is advantageous.

Alternative technology is available in the form of a clutch caddy distributed by Unique Truck Equipment, Inc., Part No. 32000. The principal disadvantage of this device is that it occupies too great of a floor area to allow one service man to operate it efficiently. Another clutch handling device is disclosed in Automotive And Heavy Duty Shop Equipment Catalog, Item No. 5015, which has similar disadvantages to the previously discussed design, and as can be seen, both designs have shafts that required bolting in order to be operative, making maneuvering difficult when inserting the shaft into the bore of a clutch or flywheel with damage resulting to the clutch or flywheel in the event of improper alignment. To alleviate these concerns and others which will become apparent from the disclosure which follows, the present invention conveniently provides for a selectably engageable shaft with specially designed means for attaching disposed on an end of the shaft which can be mated with a complementary means for attaching which is disposed on a face of the carriage. Such design permits the hoisting device to position a clutch for installation or removal and then allow the hoisting device to be removed with the shaft remaining temporarily in place. This is impossible with the above designs. Moreover, due to the considerably smaller floor profile of the instant invention, one man or woman service person can use this hoisting device to install a clutch and/or flywheel under a truck or like vehicle without the need for a second individual to assist in the installation of same.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach cumbersome structures that operate with more than one serviceman, the present invention conveniently provides a considerably smaller floor profile allowing one service person to hoist a clutch and/or flywheel under a truck or like vehicle without the need for a second individual to assist in the installation.

The selectably engageable shaft has a hook disposed on one end which can be engaged and disengaged to a movable jack carriage. This advantageous feature permits the hoisting device to position a clutch for installation or removal and then allow the hoisting device to be removed with the shaft remaining temporarily in place during installation. When a hoisted clutch is lowered after the clutch has been properly positioned for installation, the hook disengages allowing the, clutch jack to be removed. Once the shaft has disengaged from the carriage and remains in place to facilitate alignment, it can be withdrawn from the central bore at any convenient time thereafter. This is not possible with the above referenced devices.

Moreover, this improved manual lifting jack is designed specifically to lift fourteen inch or fifteen inch Spicer truck clutch assemblies. With this improved jack of the present invention, one is able to assemble and disassemble the clutch and/or flywheel completely under a truck resting on grade.

Thus, this invention provides for the first time a truck clutch jack that can be operated by one serviceman without the need to elevate the vehicle while the clutch is replaced.

Still other advantages will be apparent from the disclosure that follows.

SUMMARY OF THE INVENTION

The invention relates to an apparatus for hoisting a vehicular clutch with a central bore comprising a selectably engagable elongated shaft having a first end and a second end with means for attaching disposed on the first end. The shaft is suitably sized transversely to fit into the central bore of the clutch. An upright post with a base disposed on the bottom end of the post, a carriage supported on and movable relative to the post, and means for moving the carriage relative to the post are further provided.

The carriage has a first face with complementary means for attaching adapted for use in engaging the means for attaching to support the shaft in a generally horizontal plane.

The clutch may be hoisted by inserting the second end of the shaft into the central bore of the clutch, disposing the central bore in a horizontal position, engaging the complementary means for attaching and the means for attaching, and moving the carriage and the engaged shaft upwardly relative to the post to hoist the clutch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Preferred embodiments of the invention are described hereinafter with reference to the accompanying drawing wherein.

DETAILED DESCRIPTION OF THE INVENTION

Figures 1, 2, 3, 4, 5, 6, 7:
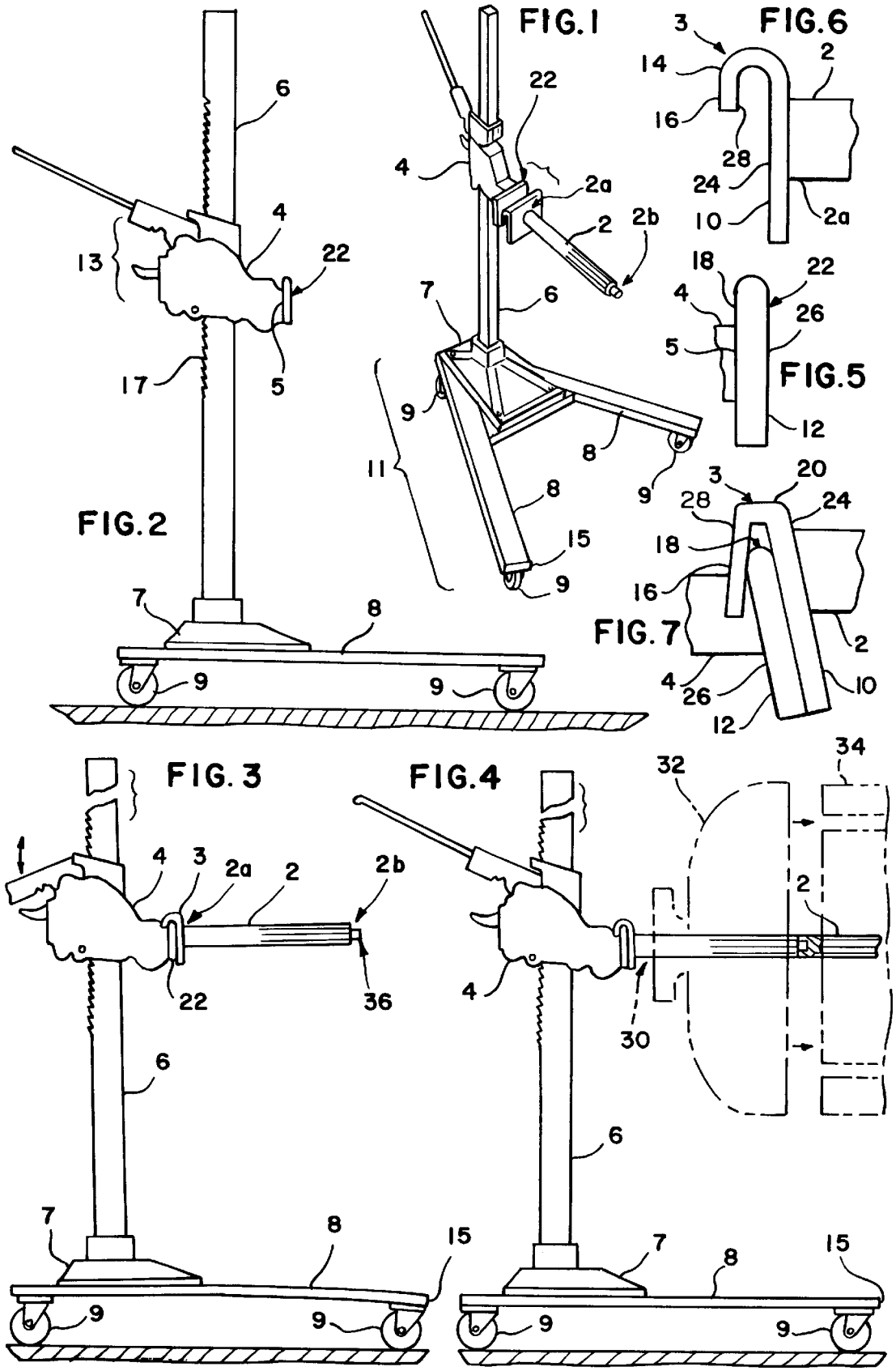
FIG. 1 is a perspective view of a first preferred embodiment of the apparatus for hoisting a vehicular clutch of the present invention showing the elongated shaft disengaged from the complementary means for attachment of the carriage.
FIG. 2 is a side elevation view of the apparatus for hoisting a vehicular clutch showing the carriage supported on the post with the post upstanding on a base including a stand and extended legs with wheels.
FIG. 3 is a side elevation view of the apparatus for hoisting a vehicular clutch showing the shaft attached to the carriage, and further showing a slightly convex contour (viewed from above) of the legs.
FIG. 4 is a side elevation view of the apparatus for hoisting a vehicular clutch showing a clutch, in phantom, supported by the shaft which is attached to the carriage, and a clutch housing, shown in phantom.
FIG. 5 is a partial side elevation view of the front face of the carriage and complementary means for attaching.
FIG. 6 is a partial side elevation view of the first end of the shaft showing the means for attaching with the engagement element thereof disposed perpendicular to the axis of the shaft.
FIG. 7 is a partial side elevation view of a second preferred embodiment of the means for apparatus for hoisting a vehicular clutch showing the means for attaching with the engagement elements thereof disposed transversely to the axis of the shaft.

The preferred embodiments depicted in the drawing include an improved clutch hoisting invention having a selectably engagable elongated shaft with a first end and a second end and means for attaching disposed on the first end, which shaft can be inserted into a central bore of a clutch, and a carriage, with a complementary means for attaching adapted for use in engaging the means for attaching to support the shaft, supported on and movable relative to an upright post with a base disposed on the bottom end of the post. A suitably sized manually actuated ratcheting mechanism raises and lowers the carriage. A standard ratcheting mechanism used on an automobile and truck jacks typically includes a gear having teeth to engage the teeth 17 at the post 6, a ratchet and lever for operating said gear, and a pawl to engage said ratchet and hold it from sliding downwardly. A selectably engageable ratchet and pawl is preferred. Alternatively, pneumatic and hydraulic cylinders may easily be substituted by one skilled in the art.

Without departing from the generality of the invention disclosed herein, the improved manual lifting jack of this invention may be employed in other capacities were the use of an insertable shaft for lifting is advantageous. A variety of drive mechanisms to move a carriage relative to the post are in use today. The means for controlling movement of the carriage relative to the post may comprise one of a hydraulic cylinder, a pneumatic pump, a ratchet and pawl, or any known substitute. Moreover, a variety of alternative configurations for fastening the selectably engagable elongated shaft to the carriage to achieve the objective of this invention will be readily apparent to those skilled in the art.

The discussion that follows, without limiting the scope of the invention, will refer to the invention as depicted in the drawing, showing an apparatus that will allow the shaft to be engaged by the carriage as the carriage is raised and allow the shaft to be disengaged by the carriage as the carriage is lowered.

The preferred embodiments of the apparatus depicted in the drawing comprise an apparatus for hoisting a vehicular clutch with a central bore 30 comprising a selectably engagable elongated shaft 2 having a first end 2*a* and a second end 2*b* with means for attaching 3 disposed on the first end 2*a*, with the shaft 2 being suitably sized transversely to fit into the central bore 30 of the clutch 32, an upright post 6 with a base 11 disposed on the bottom end of the post 6, a carriage 4 supported on and movable relative to the post 6, and means for moving 13 the carriage 4 relative to the post 6. The post 6 is preferably designed with a series of teeth or serrations 17. The carriage 4 has a first face 5 with complementary means for attaching 22 adapted for use in engaging the means for attaching 3 to support the shaft 2 in a generally horizontal plane.

The clutch 32 may be hoisted by disposing the central bore 30 in a horizontal position, inserting the second end 2*b* of the shaft 2 into the central bore 30 of the clutch 32, engaging the complementary means for attaching 22 and the means for attaching 3, and moving the carriage 4 and the engaged shaft 2 upwardly relative to the post 6 to hoist the clutch 32.

In a preferred embodiment of the apparatus, the means for attaching 3 may comprise a hook 14 with a downward bill 16 and the complementary means for attaching 22 may comprise an upwardly directed protrusion 18. As best shown in FIGS. 5 and 6, the means for attaching 3 may further comprise at least one hook 14, each of the at least one hook having a downward bill 16 and the complementary means for attaching 22 may comprise at least one upwardly directed protrusion 18. A flange 20, as shown in FIGS. 6 and 7, is suitable for the means for attaching 3 of the shaft 2.

In a preferred embodiment of the invention, the means for attaching 3 comprises an engagement element 10 disposed lower than the elevation of the end of the downward bill 16, and the complementary means for attaching 22 comprises a complementary engagement element 12 disposed lower than the elevation of the protrusion 18. The complementary engagement element 12 receives force from the engagement element 10 when the means for attaching 3 is engaged to the complementary means for attaching 22. At least one of the engagement element 10 and the complementary engagement element 12 comprises a plate. Preferably, the engagement element 10 comprises a first plate 24 and the complementary engagement element 12 comprises a second plate 26, and a first line that is perpendicular to the first plate 24 is parallel to a second line that is perpendicular the second plate 26 when the shaft 2 is engaged to the carriage 4.

Some of the preferred features include the complementary means for attaching 22 comprising a second plate 26 with the upwardly directed protrusion 18 comprising a top portion of the second plate 26, as shown in FIG. 5, and the complementary engagement element 12 comprising a bottom portion of the second plate 26; and the means for attaching 3 comprising a first plate 24 with the hook 14 comprising a folded lip 28 in a top portion of the first plate 24, the folded lip 28 being folded away from the second end 2*b* of the shaft 2, as shown in FIG. 6.

Illustrated in FIGS. 2–4 is the means for moving 13 the carriage 4 relative to the post 6 comprising a manually actuated ratcheting mechanism, representative of typical ratchets employed on manually operated vehicle jacks having a gear with teeth adapted to engage a series of teeth 17 disposed along a length of the post 6 to raise and lower the carriage 4.

Protrusion 18 of the carriage preferably lowers to a point where it can pick up the shaft while disposed in a clutch.

Preferably the carriage allows the protrusion to operate in the range of approximately 7" above grade to approximately 45" inches above grade. This range is by no means a limitation on the instant invention, but it is a preferred range which will accommodate a wide variety of truck models and generations.

To accommodate the weight of a clutch 32, the apparatus of the current invention has a base 11 with a plurality of non-parallel legs 8 extending outwardly from a jack stand 7 upon which the post 6 is supported, as best shown in FIG. 1. Preferably, at least two of the plurality of non-parallel legs 8 extend away from the jack stand 7 in the general direction of the first face 5 relative to the post 6.

Referring to FIGS. 1–4, a preferred embodiment is shown wherein the plurality of non-parallel legs comprises two legs 8, each lying in a generally horizontal plane, having a common intersection proximate to the jack stand 7 and extending in the general direction of the first face 5 relative to the post 6.

The apparatus of this clutch hoisting invention is an improvement over existing jacks having an upright post with a base disposed on the bottom end of the post, a carriage supported on and movable relative to the post, a manually actuated ratcheting mechanism to raise and lower the carriage, in that it comprises improved elements including a selectably engagable elongated shaft 2 having a first end 2*a* and a second end 2*b* with means for attaching 3 disposed on the first end 2*a*, which shaft 2 is suitably sized transversely to fit into a central bore 30 of a clutch 32, and its carriage 4 has a first face 5 with complementary means for attaching 22 adapted for use in engaging the means for attaching 3 to support the shaft 2 in a generally horizontal plane. Advantageously, the clutch 32 may be hoisted by disposing the central bore 30 in a horizontal position, inserting the second end 2*b* of the shaft 2 into the central bore 30 of the clutch 32, engaging the complementary means for attaching 22 and the means for attaching 3, and moving the carriage 4 and the engaged shaft 2 upwardly relative to the post 6 to hoist the clutch 32. Furthermore, it can be operated by one serviceman without the need to elevate the vehicle while the clutch 32 is replaced. The apparatus of this invention works equally well on flywheel repair and replacements.

Referring to FIG. 6, a preferred embodiment of the clutch hoisting apparatus shows the shaft 2 being perpendicular to the first plate 24. In another embodiment of this important invention, the selectably engagable elongated shaft 2, as shown in FIG. 7, is transverse to the first plate 24. Since the post 6 may pitch in the direction of the first face 5 of the carriage 4 while hoisting a clutch 32 or flywheel, this embodiment of the engagement element 10 disposed transversely to the shaft 2, with the bottom portion of the engagement element disposed closer to the second end 2*b* of the shaft 2 than the remaining portion of said engagement element 10 angularly disperses the cantilevered load. Correspondingly, its downward bill 16 is vertically disposed to allow it to easily slip over the protrusion 18 of the complementary means of engagement 12. The complementary engagement element 12 of the carriage 4 may be disposed at a similar transverse angle, as shown in FIG. 7. While a flat plate is shown as a preferred embodiment for the engagement element 10 and complementary engagement element 12, any opposing contact surfaces and/or points would suffice. Any at least one surface and/or point for opposing such rotational forces would be required.

In a preferred embodiment of the present invention as shown in FIG. 3, means for absorbing that allows the post to move between a first position in which the post is canted in a general direction away from the first face relative to the post and a second load bearing position in which the post is generally vertical are provided. The means for absorbing 8*a* may comprises a slight upward bow in each of the at least two of said plurality of non-parallel legs with a medial portion of said legs being elevated relative to the ends thereof. A common leaf spring or like device may be employed for this purpose. An alternative brace could also be used.

As can be seen this invention is an improvement over an existing jack having a base with a receiving slot. The base of the instant invention includes a stand 7 augmented with a pair of legs 8 extending in the general direction of the complementary means for adapting 22. These extended legs 8 are approximately 24 inches in length and the floor space occupied by this device is represented by the exterior of the legs being 7 inches at its juncture and 24 inches from one extended end 15 to the other. The extended legs are made of quarter inch base metal preferably with four caster wheels 9.

Clearly, enhancements in size or quality of the materials used in the apparatus would serve to reduce any pitching effect.

A preferred method for hoisting a vehicular clutch with a central bore is provided herein comprising the following steps: a. disposing the central bore of the vehicular clutch in a horizontal position; b. inserting into the central bore a second end of a selectably engagable elongated shaft that has means for attaching disposed proximate to a first end of the shaft; c. engaging the means for attaching with complementary means for attaching that is disposed on a carriage supported on and movable relative to an upright post; and d. moving the carriage, with the engaged shaft and clutch, upwardly relative to the post to hoist the clutch.

A method for installing a truck clutch with a central bore in a truck while the truck is parked on the ground is provided herein comprising the following steps: a. disposing the central bore of the truck clutch in a horizontal position; b. inserting into the central bore a second end of a selectably engagable elongated shaft that has a second end and means for attaching disposed proximate to a first end of the shaft; c. engaging the means for attaching with complementary means for attaching that is disposed on a carriage supported on and movable relative to an upright post which has a base with rollers; d. moving the carriage, with the engaged shaft and clutch, upwardly relative to the post to hoist the clutch; e. rolling the base supporting the post, carriage, shaft and clutch, under the truck and aligning bolt holes of the clutch with bolt holes of a clutch housing of the truck; f. inserting and at least partially tightening a plurality of bolts to fasten the clutch to the clutch housing of the truck; and g. withdrawing the second end of a selectably engagable elongated shaft from the central bore of the clutch by rolling under the truck the base supporting the post, carriage, and shaft in the direction of the second end of the shaft relative to the first end of the shaft.

A preferred method for installing a truck clutch with a central bore in a truck while the truck is parked on the ground is further provided consisting of the following steps: a. disposing the central bore of the truck clutch in a horizontal position; b. inserting into the central bore a second end of a selectably engagable elongated shaft that has a second end and means for attaching disposed proximate to a first end of the shaft; c. engaging the means for attaching with complementary means for attaching that is disposed on a carriage supported on and movable relative to an upright post which has a base with rollers; d. moving the carriage, with the engaged shaft and clutch, upwardly relative to the post to hoist the clutch; e. rolling the base supporting the post, carriage, shaft and clutch, under the truck and aligning bolt holes of the clutch with bolt holes of a clutch housing of the truck; f. inserting and at least partially tightening a plurality of bolts to fasten the clutch to the clutch housing of the truck; and g. withdrawing the second end of a selectably engagable elongated shaft from the central bore of the clutch by rolling under the truck the base supporting the post, carriage, and shaft in the direction of the second end of the shaft relative to the first end of the shaft. A preferred shaft 2 includes a two inch radial step reduction 36 at its second end 2*b* for insertion into a recess in the transmission of the vehicle.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

The invention resides not in any one of these features per se, but rather in the particular combination of all of them herein disclosed and claimed and it is distinguished from the prior art in this particular combination of all of its structures for the function specified.

For a better understanding of the invention, its operating advantages and the specific objects attained by its uses, reference should be had to the accompanying drawing and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. An apparatus for hoisting a vehicular clutch with a central bore comprising:

a. an upright post with a base disposed on the bottom end of the post;

b. a carriage supported on and movable relative to said post;

c. a selectively engagable elongated shaft having a first end for selectively engaging the carriage and a second end for selectively engaging the clutch, with means for attaching independent of moving parts disposed on the first end, said shaft being suitably sized transversely to fit into the central bore of the clutch, and said carriage having a first face with complementary means for attaching independent of moving parts adapted for use in selectively engaging the means for attaching to independently support the shaft in a generally horizontal plane; and d. means for moving the carriage relative to said post, whereby, the clutch can be hoisted by disposing the central bore in a horizontal position, inserting the second end of the shaft into the central bore of the clutch, engaging the complementary means for attaching and the means for attaching, moving the carriage and the engaged shaft upwardly relative to the post to hoist the clutch, aligning the clutch for installation, and selectively disengaging carriage from the shaft by moving the carriage downwardly while leaving the shaft disposed in the central bore of the clutch.

2. The apparatus of claim 1, wherein the means for attaching comprises a hook with a downward bill, and wherein the complementary means for attaching comprises an upwardly directed protrusion.

3. The apparatus of claim 1, wherein the means for attaching comprises at least one hook, each of said at least one hook having a downward bill, and wherein the complementary means for attaching comprises at least one upwardly directed protrusion.

4. The apparatus of claim 1, wherein the means for attaching comprises a flange, and wherein the complementary means for attaching comprises an upwardly directed protrusion.

5. The apparatus of claim 2, wherein the means for attaching further comprises an engagement element disposed lower than the elevation of the end of the downward bill, and wherein the complementary means for attaching further comprises a complementary engagement element disposed lower than the elevation of the protrusion, said complementary engagement element receives force from the engagement element when the means for attaching is engaged to the complementary means for attaching.

6. The apparatus of claim 5, wherein at least one of the engagement element and the complementary engagement element comprises a plate.

7. The apparatus of claim 5, wherein engagement element comprises a first plate and the complementary engagement element comprises a second plate.

8. The apparatus of claim 7, wherein the shaft is perpendicular to the first plate.

9. The apparatus of claim 7, wherein the shaft is transverse to the first plate.

10. The apparatus of claim 7, wherein a first line that is perpendicular to the first plate is parallel to a second line that is perpendicular the second plate.

11. The apparatus of claim 5, wherein the complementary means for attaching comprises a second plate with the upwardly directed protrusion comprising a top portion of said second plate and the complementary engagement element comprising a bottom portion of said second plate.

12. The apparatus of claim 5, wherein the means for attaching comprises a first plate with the hook comprising a folded lip in a top portion of said first plate, said folded lip being folded away from the second end of the shaft.

13. The apparatus of claim 1, wherein the means for moving the carriage relative to the post comprises a manually actuated ratcheting mechanism having a gear with teeth adapted to engage a series of teeth disposed along a length of the post to raise and lower the carriage.

14. The apparatus of claim 1, wherein the base has a plurality of non-parallel legs extending outwardly from a jack stand upon which the post is supported.

15. The apparatus of claim 14, wherein at least two of said plurality of non-parallel legs extend away from said jack stand in the general direction of the first face relative to the post.

16. The apparatus of claim 15, wherein each of the at least two of said plurality of non-parallel legs comprises means for absorbing that allows the post to move between a first position in which the post is canted in a general direction away from the first face relative to the post and a second load bearing position in which the post is generally vertical.

17. The apparatus of claim 16, wherein the means for absorbing comprises a slight upward bow in each of the at least two of said plurality of non-parallel legs with a medial portion of said legs being elevated relative to the ends thereof.

18. The apparatus of claim 14, wherein said plurality of non-parallel legs comprises two legs, each lying in a generally horizontal plane, having a common intersection proximate to the jack stand and extending in the general direction of the first face relative to the post.

19. An improved jack of the type having an upright post with a base disposed on the bottom end of the post, a carriage supported on and movable relative to said post, a mechanism to raise and lower the carriage, wherein the improvement comprises:

a. a selectively engagable elongated shaft having a first end for selectively engaging the carriage and a second end for selectively engaging the clutch, with means for attaching disposed on the first end, said shaft being suitably sized transversely to fit into a central bore of a clutch; and b. said carriage having a first face with complementary means for attaching independent of moving parts adapted for use in selectively engaging the means for attaching to independently support the shaft in a generally horizontal plane, whereby, the clutch can be hoisted by disposing the central bore in a horizontal position, inserting the second end of the shaft into the central bore of the clutch, engaging the complementary means for attaching and the means for attaching, moving the carriage and the engaged shaft upwardly relative to the post to hoist the clutch, aligning the clutch for installation, and selectively disengaging carriage from the shaft by moving the carriage downwardly while leaving the shaft disposed in the central bore of the clutch.

20. An apparatus for hoisting a vehicular clutch with a central bore comprising:

a. an upright post with a base disposed on the bottom end of the post, said base has a plurality of non-parallel legs extending outwardly from a jack stand upon which the post is supported, wherein at least two of said plurality of non-parallel legs extend away from said jack stand in the general direction of a first face relative to the post, and wherein each of the at least two of said plurality of non-parallel legs comprises means for absorbing that allows the post to move between a first position in which the post is canted in a general direction away from the first face relative to the post and a second load bearing position in which the post is generally vertical;

b. a selectively engagable elongated shaft having a first end for selectively engaging a carriage and a second end for selectively engaging the clutch, with means for attaching independent of moving parts disposed on the first end, said shaft being suitably sized transversely to fit into the central bore of the clutch;

c. a carriage supported on and movable relative to said post, said carriage having a first face with complementary means for attaching independent of moving parts adapted for use in engaging the means for attaching to independently support the shaft in a generally horizontal plane; and d. means for moving the carriage relative to said post, whereby, the clutch may be hoisted by disposing the central bore in a horizontal position, inserting the second end of the shaft into the central bore of the clutch, engaging the complementary means for attaching and the means for attaching, and moving the carriage and the engaged shaft upwardly relative to the post to hoist the clutch, aligning the clutch for installation, and selectively disengaging carriage from the shaft by moving the carriage downwardly while leaving the shaft disposed in the central bore of the clutch.

21. The apparatus of claim 20, wherein the means for absorbing comprises a slight upward bow in each of the at least two of said plurality of non-parallel legs with a medial portion of said legs being elevated relative to the ends thereof.

* * * * *